US006749802B2

(12) United States Patent
Amick

(10) Patent No.: US 6,749,802 B2
(45) Date of Patent: Jun. 15, 2004

(54) PRESSING PROCESS FOR TUNGSTEN ARTICLES

(76) Inventor: Darryl D. Amick, 3227 Countryman Cir. NW., Albany, OR (US) 97321

( * ) Notice: Subject to any disclaimer, the term of this patent is extended or adjusted under 35 U.S.C. 154(b) by 122 days.

(21) Appl. No.: 10/061,759

(22) Filed: Jan. 30, 2002

(65) Prior Publication Data

US 2003/0143099 A1 Jul. 31, 2003

(51) Int. Cl.[7] ..... C22C 1/04; C22C 27/04

(52) U.S. Cl. ..... 419/37; 419/65; 75/228; 75/248; 102/517

(58) Field of Search ..... 419/37, 65; 75/228, 75/248; 102/517

(56) References Cited

U.S. PATENT DOCUMENTS

| | | | |
|---|---|---|---|
| 1,847,617 | A | 3/1932 | Löwenstein et al. |
| 2,119,876 | A | 6/1938 | Corson |
| 2,183,359 | A | 12/1939 | Smithells |
| 2,919,471 | A | 1/1960 | Hechinger |
| 2,995,090 | A | 8/1961 | Daubenspeck |
| 3,123,003 | A | 3/1964 | Lange, Jr. et al. |
| 3,372,021 | A | 3/1968 | Forbes et al. |
| 3,623,849 | A | 11/1971 | Benjamin |
| 3,785,801 | A | 1/1974 | Benjamin |
| 3,888,636 | A | 6/1975 | Sczerzenie et al. |
| 3,890,145 | A | 6/1975 | Hivert et al. |
| 3,953,194 | A | 4/1976 | Hartline, III et al. |
| 3,979,234 | A | 9/1976 | Northcutt, Jr. et al. |
| 4,027,594 | A | 6/1977 | Olin et al. |
| 4,035,115 | A | 7/1977 | Hansen |
| 4,035,116 | A | 7/1977 | O'Brien et al. |
| 4,138,249 | A | 2/1979 | Rosof |
| 4,274,940 | A | 6/1981 | Plancqueel et al. |
| 4,338,126 | A | 7/1982 | Vanderpool et al. |
| 4,383,853 | A | 5/1983 | Zapffe |
| 4,428,295 | A | 1/1984 | Urs |
| 4,488,959 | A | 12/1984 | Agar |
| 4,760,794 | A | 8/1988 | Allen |
| 4,762,559 | A | 8/1988 | Penrice et al. |
| 4,780,981 | A | 11/1988 | Hayward et al. |

(List continued on next page.)

FOREIGN PATENT DOCUMENTS

| | | |
|---|---|---|
| CA | 521944 | 2/1956 |
| GB | 731237 | 6/1955 |
| GB | 2149067 | 6/1985 |
| JP | 52-68800 | 6/1977 |
| JP | 59-6305 | 1/1984 |
| JP | 1-142002 | 6/1989 |
| WO | WO 00/37878 | 6/2000 |

OTHER PUBLICATIONS

"Steel 3–inch Magnum Loads Our Pick For Waterfowl Hunting," *Gun Tests,* Jan. 1998, pp. 25–27.

Carmichel, Jim, "Heavy Metal Showdown," *Outdoor Life,* Apr. 1997, pp. 73–78.

"Federal's New Tungsten Pellets," *American Hunter,* Jan. 1997, pp. 19, 48–50.

*Primary Examiner*—Daniel Jenkins
(74) *Attorney, Agent, or Firm*—Kolisch Hartwell, P.C.

(57) ABSTRACT

A manufacturing process for articles that are formed from powders containing tungsten and at least one binder. The manufacturing process includes compacting the mixture of powders under a first pressure to yield a desired intermediate structure, then reshaping the structure under a second pressure that is lower than the first pressure to yield the desired article. The binder utilized in the manufacturing process may include a metallic binder or a non-metallic binder, or both. The process is particularly suited for the manufacture of lead substitutes, including firearms projectiles, such as a bullet or shot. Such projectiles may be ferromagnetic or non-ferromagnetic, frangible or infrangible, and jacketed or unjacketed.

55 Claims, 4 Drawing Sheets

U.S. PATENT DOCUMENTS 4,784,690 A 11/1988 Mullendore
4,881,465 A 11/1989 Hooper et al.
4,897,117 A 1/1990 Penrice
4,931,252 A 6/1990 Brunisholz et al.
4,940,404 A 7/1990 Ammon et al.
4,949,644 A 8/1990 Brown
4,949,645 A 8/1990 Hayward et al.
4,960,563 A 10/1990 Nicolas
4,961,383 A 10/1990 Fishman et al.
4,990,195 A 2/1991 Spencer et al.
5,069,869 A 12/1991 Nicolas et al.
5,088,415 A 2/1992 Huffman et al.
5,264,022 A 11/1993 Haygarth et al.
5,279,787 A 1/1994 Oltrogge
5,399,187 A 3/1995 Mravic et al.
5,527,376 A 6/1996 Amick et al.
5,616,642 A * 4/1997 West et al. ..... 524/439
5,713,981 A 2/1998 Amick
5,719,352 A 2/1998 Griffin
5,740,516 A 4/1998 Jiranek, II et al.
5,760,331 A 6/1998 Lowden et al.
5,786,416 A 7/1998 Gardner et al.
5,814,759 A 9/1998 Mravic et al.
5,820,707 A 10/1998 Amick et al.
5,831,188 A 11/1998 Amick et al.
5,847,313 A 12/1998 Beal
5,868,879 A 2/1999 Amick et al.
5,877,437 A 3/1999 Oltrogge
5,894,644 A 4/1999 Mravic
5,905,936 A 5/1999 Fenwick et al.
5,913,256 A 6/1999 Lowden et al.
5,917,143 A 6/1999 Stone
5,922,978 A 7/1999 Carroll
5,950,064 A 9/1999 Robinson et al.
5,963,776 A 10/1999 Lowden et al.
6,090,178 A 7/2000 Benini
6,136,105 A 10/2000 Spencer
6,371,029 B1 4/2002 Beal
6,457,417 B1 10/2002 Beal
6,551,375 B2 4/2003 Siddle et al.
6,551,376 B1 4/2003 Beal
6,581,523 B2 6/2003 Beal
6,591,730 B2 7/2003 Beal
2002/0124759 A1 9/2002 Amick
2002/0152915 A1 10/2002 Vaughn et al.

* cited by examiner

50'
52
MIX POWDER(S) AND BINDER(S)
54
PLACE IN COMPACTING DIE
56
COMPACT INTO INTERMEDIATE STRUCTURE
58'
PLACE INTO RESHAPING DIE CONTAINING JACKET
60
RESHAPE INTO (NEAR) NET FINAL SHAPE
66
HEAT
64
ACTIVATE BINDER
62'
SEAL JACKET
68
ASSEMBLE FINISHED ARTICLE 90
91
92
93
94
95

100
91
92
93
94
95
96

105
90
91
102
104
106
108

110
91
95
96
102
104
106
108

PRESSING PROCESS FOR TUNGSTEN ARTICLES

FIELD OF THE INVENTION

The present invention relates generally to the field of powder metallurgy, and more particularly to articles formed from compositions of matter that include a tungsten-containing powder and at least one binder.

BACKGROUND OF THE INVENTION

Conventionally, many articles have been produced from lead because of lead's relatively high density (11.3 g/cc) and relatively inexpensive cost. Examples of such articles include firearms projectiles, radiation shields and various weights. More recently, lead substitutes have been sought because of the toxicity of lead. For example, in 1996 the Environmental Protection Agency banned the use of lead shotgun shot for hunting waterfowl. Various lead substitutes have been used, including steel, bismuth and tungsten, with each offering various advantages and disadvantages as compared to lead.

One solution to the toxicity of lead is to form articles from a lead-substitute, such as tungsten or a tungsten alloy. Although such tungsten-containing articles may possess desirable properties, including relatively high densities, many tungsten mixtures and alloys are also hard and abrasive, which makes machining and shaping of such articles difficult. In order to effectively shape such articles, tools that are also extremely hard are required. For example, tools may need to be made or edged with tungsten carbide, such as tungsten carbide in a cobalt matrix. Unfortunately, although tungsten carbide is very hard, it is also relatively brittle. As a result, besides being more expensive, such tools typically have a shorter life. For example, attempts to shape or work tungsten-containing articles using thin-edged tungsten carbide tools or punches have frequently resulted in damage to the tools themselves, at a substantial cost.

BACKGROUND OF THE INVENTION

The present invention is directed to manufacturing processes for articles that are formed from powders containing tungsten and at least one binder. The manufacturing process includes compacting the mixture of powders under a first pressure to yield a desired intermediate structure, then reshaping the structure under a second pressure that is lower than the first pressure to yield the desired article. Appropriately durable tools may be used for the high-pressure compaction step, while more precise tools may be used for the lower-pressure reforming step.

In some embodiments, the manufactured article contains at least one metallic binder. In some embodiments, the article contains at least one non-metallic binder, such as a polymeric binder. In some embodiments, the article contains both a metallic binder and a non-metallic binder. In some embodiments the article is a lead substitute. In some embodiments the article is a firearms projectile, such as a bullet or shot, which may be ferromagnetic or non-ferromagnetic, which may be frangible or infrangible, and which may be jacketed or unjacketed.

DETAILED DESCRIPTION AND BEST MODE OF THE INVENTION

The present invention is directed to methods for forming tungsten-containing articles from a mixture containing a tungsten-containing powder and a binder. The method involves compacting the mixture to form an intermediate structure having generally the desired density of the article to be produced but a different shape from the article to be produced. The intermediate structure is then reformed, or reshaped, by compression at a lower pressure to form an article having a shape that is different from the shape of the intermediate structure. In some embodiments of the invention, the intermediate structure and article will have the same density. In others, they will have densities that differ by less than 1 g/cc and preferably, less than 0.05 g/cc, or even less than 0.02 g/cc or 0.01 g/cc.

Figure 1:
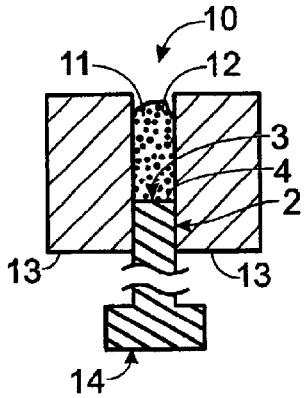
FIG. 1 is a schematic cross-sectional view of a die loaded with a mixture including a tungsten-containing powder and a binder, according to one aspect of the present invention.
Figure 2:
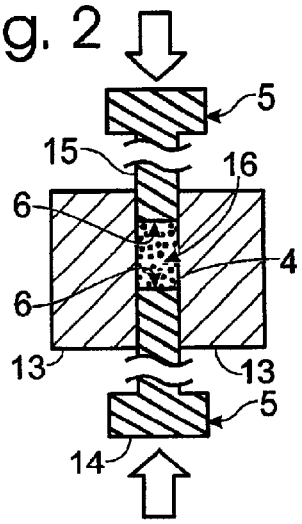
FIG. 2 is a schematic cross-sectional view of the die of FIG. 1 where the mixture is undergoing compaction with upper and lower punches to form an intermediate structure.
Figure 3:
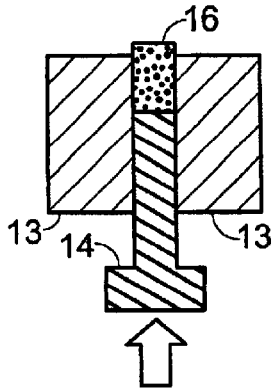
FIG. 3 is a schematic cross-sectional view of the die of FIGS. 1 and 2, where the lower punch is ejecting the intermediate structure.

The first, or compacting, step of the process of the invention is shown schematically in FIGS. 1–3. In FIG. 1 a mixture 10 of powders has been placed in a first die 13 that includes a lower punch 14. The mixture 10 includes at least one tungsten-containing powder 11 and at least one binder 12. Binder 12 may be, but is not necessarily, in powder form. It should be understood that as used herein, the term "powder" is meant to include particulate having a variety of shapes and sizes, including generally spherical or irregular shapes, flakes, needle-like particles, chips, fibers, equiaxed particles, etc.

After the desired amount of mixture 10 has been placed in the first die, the second, or upper punch 15 is placed in position, as shown in FIG. 2, and compacting pressure is applied to the powder mixture to yield a compacted intermediate structure 16. The pressure applied during the compacting step may vary, but is typically high enough to consolidate the loose powder into a solid structure while reducing the microporosity of the composition, and concomitantly increasing the density of the composition.

Although the compaction and reshaping processes are graphically illustrated as utilizing a single die with both an upper and a lower punch, this arrangement is not required, and numerous variations may be envisioned by one of skill in the art of powder metallurgy, without departing from the scope of the invention. For example, the compaction step may be accomplished with a die with a cavity with a single opening and a single punch, or a multi-piece die in combination with one or two punches, or even a multi-cavity die with multiple single- or double-acting punches. Generally speaking, the manufacturing process is simplified by using a die having a cavity with generally opposed openings and a pair of punches that are respectively adapted to be inserted into the openings.

It should be understood that the dies and punches illustrated herein are shown somewhat schematically, and that the precise shape, size and configuration of these components may vary within the scope of the invention. For example, the sizing and shape of the die and/or punches may vary depending upon the type and shape of structure or article to be produced therein, the amount of pressure to be applied, etc. As used herein, the term punch assembly will be used to refer to the punch or punches that are adapted to be inserted into a die, such as to form structure 16 or the subsequently described near final net shape or final net shape articles. Each punch includes a head, or body, that includes a face that is adapted to contact, or engage, the mixture or intermediate structure as the punch assembly is used to apply pressure, or compact, the mixture or intermediate structure. As indicated graphically in FIG. 1 with respect to punch 14, the head, or body, is indicated at 2, with the face indicated at 3. In the context, forming the intermediate structure from mixture 10, the punch or punches may be referred to as part of a compaction punch assembly 5, and the faces may be referred to as mixture-contacting faces 6, as indicated in FIG. 2. In the illustrative example shown in FIG. 2, mixture-contacting face 6 includes an outer perimeter 4, which as shown has a flat shape. It is within the scope of the invention that mixture-contacting faces may have other configurations, such as only substantially flat faces, faces that are concave, in which the outer perimeter extends from the body more than the rest of the face, or expressed differently, that the outer perimeter extends in the direction at which the punch applies compression to mixture 10 further than the rest of the face. It is also within the scope of the invention that face 6 may have a convex configuration, in which case the above description is reversed.

The compaction and consolidation step typically involves an applied pressure of approximately 50,000 lbs/in$^2$ or more, such as to achieve adequate consolidation of the composition and/or to achieve a desired density that is near or above the density of lead. More typically, the applied pressure is greater than approximately 65,000 lbs/in$^2$, and in some embodiments is preferably greater than approximately 75,000 lbs/in$^2$. In some embodiments, the compaction pressure may be selected to be at least 80,000 lbs/in$^2$, 90,000 lbs/in$^2$ or even 100,000 lbs/in$^2$. It should be understood that there is at least some relationship between the applied compaction pressure and the density of the resulting structure. It is within the scope of the invention that structure 16 may have essentially any selected density, depending upon the composition of mixture 10 and the amount of applied pressure. Typically, structure 16 will have a density of at least 8 g/cc, and often will have a density of at least 9 g/cc or at least 10 g/cc. For example, structure 16 may have a density in the range of 10 g/cc and 13 g/cc, a density in the range of 11 g/cc and 11.5 g/cc, a density that is equal to or near the density of lead, or a conventional lead alloy, and as a further example, that structure 16 has a density that is greater than lead, such as a density that is greater than 11.5 g/cc, 12 g/cc or more.

For example, the following table presents illustrative examples of how the compaction punch assembly may create intermediate structures 16 having a variety of densities depending upon the composition of mixture 10 and the amount of applied pressure.

TABLE 1

Illustrative Compositions and Densities for Intermediate Structures at Selected Compaction Pressures

| Composition (wt %) | Density after 48300 psi | Density after 58000 psi | Density after 67600 psi | Density after 77300 psi |
|---|---|---|---|---|
| 78 FeW<br>21.8 Sn<br>0.2 wax | 11.1 | 11.1 | 11.3 | 11.3 |
| 68 FeW<br>10 WHA<br>21.8 Sn<br>0.2 wax | 11.2 | 11.3 | 11.5 | 11.6 |
| 58 FeW<br>20 WHA<br>21.8 Sn<br>0.2 wax | 11.3 | 11.4 | 11.6 | 11.7 |

After compaction (or densification), the intermediate structure typically is removed from the die, such as by removing one of the punches and ejecting the structure from the die by advancing the opposing punch 14. It should be understood that in many embodiments it is possible to remove structure 16 from either direction, depending for example upon which punch is removed first. In some embodiments, such as discussed with respect to FIG. 5, the die is configured to have structure 16 ejected from a single direction.

In order to withstand the pressures that may be required to achieve the desired density in structure 16, punches 14 and 15 may be formed from or include tungsten carbide. This is particularly true where tungsten-containing powder 11 includes ferrotungsten, which is particularly hard and abrasive. However, although tungsten carbide is very hard, it may be somewhat brittle. Therefore, in one aspect of the invention, punches 14 and 15 are shaped so as to avoid thin edges that may fail under high compression loads. Typically, die 13 and punches 14 and 15 are configured so as to produce an intermediate structure 16 that has rotational symmetry around an axis that is coincident with the vector of the applied compression. Put another way, intermediate structure 16 is typically shaped so that it has a substantially circular cross-section along every plane orthogonal to the vector along which compression was applied.

Figure 4:
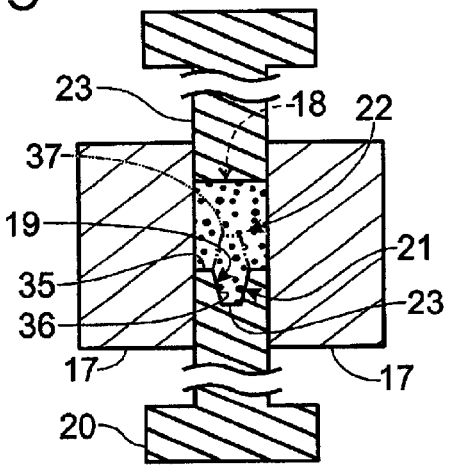
FIG. 4 is a schematic cross-sectional view of a die loaded with a mixture of powders undergoing compaction with upper and lower punches to form another intermediate structure according to the present invention.

In FIGS. 1–3, die 13 and punches 14 and 15 are configured to produce an intermediate structure 16 that is at least substantially a right cylinder in shape. As an example of such an embodiment, die 13 may define an at least substantially cylindrical void, with punches 14 and 15 having circular faces that are flat or at least substantially flat. In FIG. 4, die 17 defines a tubular void, or cavity, 18, and the face 19 of punch 20 is shaped so that the corresponding face, or end region 21, of intermediate structure 22 includes a projecting frustoconical section 23. Thin edges, or "knife-edges" along the perimeter of the face of punch 20 are avoided by including a lip or shoulder at the base of the frustoconical section. Where such features are present, the lip or shoulder is preferably at least approximately 0.01 inches wide, and in some embodiments may be 0.02 inches wide or more.

As also shown for example in FIG. 4, mixture-contacting face 19 includes an edge region 35 that defines the above-described shoulder. In the illustrated embodiment, edge region 35 extends generally transverse to the direction in which the compaction pressure is applied to mixture 10, but it is within the scope of the invention that the edge region may extend generally toward or away from the other punch and that the edge region may have linear or curved configurations. As also shown in FIG. 4, face 19 includes a recess, or depression, 36 internal of edge region 35. When used to form structure 16, face 19 produces an intermediate structure having a corresponding projecting region that is defined at least in part by the shape of recess 36. As indicated in dashed lines at 37 in FIG. 4, it is also within the scope of the invention that face 19 may include a projection internal of edge region 35, in which case structure 16 would have a corresponding recess that is defined at least in part by the projection. Although only one of the punches shown in FIG. 4 includes such a shaped face 19, it is within the scope of the invention that both punches may include faces with projections or recesses, and it is further within the scope of the invention that the face(s) may include projections or recesses with configurations other than those illustrated herein.

Figure 5:
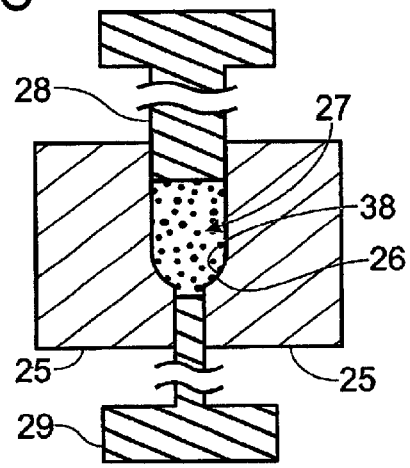
FIG. 5 is a schematic cross-sectional view of a die loaded with a mixture undergoing compaction with upper and lower punches to form another intermediate structure according to the present invention.

Another example of a suitable die and compaction punch assembly is shown in FIG. 5, in which die 25 itself defines at least a portion of the desired shape of a face, or end region, 26 of the intermediate structure 27. As shown, die 25 includes a neck, or internally projecting region, 38 that defines at least a portion of end region 26 of structure 27, which as shown takes the form of a bullet or bullet core. In the illustrative embodiment, region 38 imparts a tapered or curved shape to end region 38, while punches 28 and 29 retain at least substantially flat faces. A benefit of such a construction is that both punches have at least substantially flat faces, which tend to be more durable and less expensive than shaped punches, and that structure 16 may include configurations that would otherwise require a very thin or knife-edged punch. However, die 25 will tend to be more expensive and less durable than a corresponding die having cylindrical or otherwise uniform cross-section cavities, such as shown in FIGS. 1–4.

Figure 6:
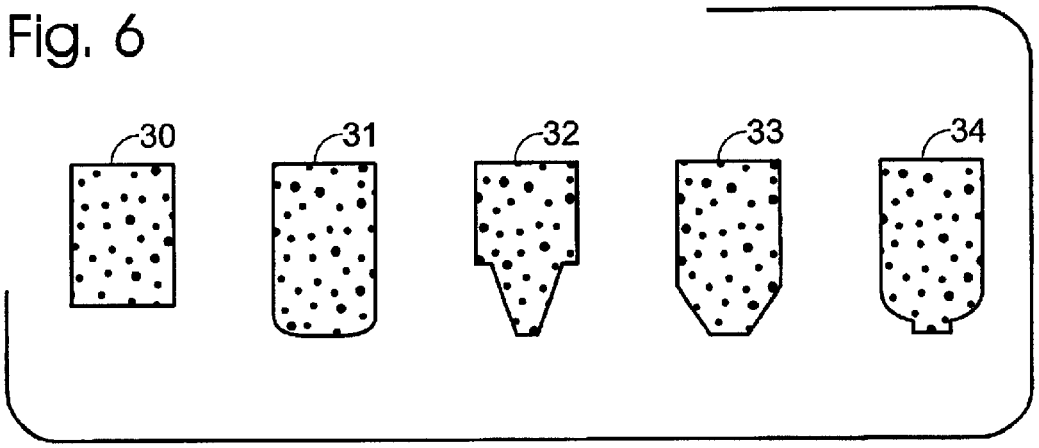
FIG. 6 is a schematic diagram showing illustrative examples of compacted intermediate structures according to the present invention.

By varying the size and shape of the die, and the shape and size of the punches (and corresponding faces), a broad variety of intermediate structures may be pressed to the desired density, as shown in FIG. 6, including, without limitation, a structure 30 having a right cylindrical configuration, a structure 31 with a face that is substantially convex, a structure 32 with a face having a lip and a frustoconical section, a structure 33 having a substantially frustoconical face 33, and a structure 34 cylinder having a substantially convex face with an additional projection or irregularity arising from the pressing process, as indicated in FIG. 5.

Once an intermediate structure having a desired density has been formed, that structure is reshaped at a lower applied pressure into a desired article having a net final shape or near net final shape. By "net final shape," is meant that the article has the appropriate shape for its intended use, or for assembly into a finished article, with no further machining or reshaping. By "near net final shape," it is meant that the article requires only minor reshaping or machining in order to obtain the appropriate shape for its intended use, or for assembly into a finished article. Such minor reshaping or machining includes, without limitation, sanding, polishing, grinding, buffing, or other such finishing process. Similarly, the drilling of cavities, threaded receivers, slots, or other fine structure in the article is also considered minor reshaping or machining in an article of near net final shape.

Because intermediate structure 16 undergoes a reforming or reshaping process according to the present invention, it may also be described as being a blank, in that it may be reformed into a variety of (near) net final shapes. Accordingly, structure 16 may also be described as having a different shape than the article produced during the reshaping step. For example, the article may be longer, shorter, more or less pointed, more or less curved, may have a greater or narrower shoulder, etc.

During the reshaping, or reforming, step, the pressure applied to the intermediate structure should be high enough to break and rebind the powder matrix formed during the compaction step, without any, or only minimal, loss of density or decrease in structural integrity of the desired article. Accordingly, the applied pressure for this step will tend to vary depending upon the particular configuration of structure 16, the (near) net final shape of the article to be produced, the composition of mixture 10, the desired density of the article to be produced, etc. As an illustrative example, when forming a firearms projectile having a density of at least 10 g/cc, and preferably near or equal to the density of lead, the applied pressure during the reshaping step is typically greater than 25,000 lbs/in$^2$, such as in the range of approximately 35,000 lbs/in$^2$ and approximately 50,000 lbs/in$^2$, and in many embodiments is preferably greater than 45,000 lbs/in$^2$. In order to avoid the deleterious effects of extremely high pressure on the tools used, it is preferred that the reshaping pressure is less than approximately 75,000 lbs/in$^2$.

The reshaping pressure to be applied tends to vary with how close the intermediate structure is to the desired net final shape. Although an intermediate structure that is a right cylinder is preferred in terms of ease of manufacturing and stress on the punches and dies during the compacting step, a right cylinder must typically undergo comparatively more 'flow' upon reshaping to produce an article having a projecting face, such as the nose of a bullet. In contrast, attempting to press an intermediate structure with a pronounced projecting face will typically require comparatively more expensive and fragile tungsten carbide punches and/or dies that incorporate thin edges or features, which often lead to earlier failure of the tools. An example of an embodiment for structure 16 that draws from the benefits of both of these approaches is a shape that is in between a right cylinder and the shape of the desired article. In the case of an article that is a bullet, such a shape typically includes a face having a conical or frustoconical surface, so that relatively less flow is required to achieve the desired shape of the final article. However, and as discussed herein, a variety of shapes may be used and are within the scope of the invention.

Figure 7:
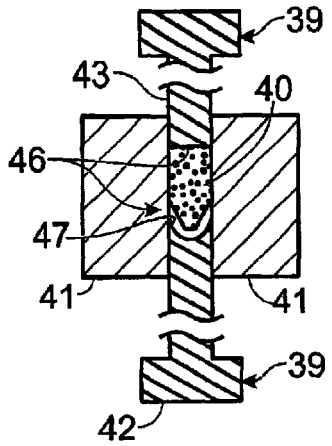
FIG. 7 is a schematic cross-sectional view of a reshaping die loaded with an intermediate compacted structure, according to an aspect of the present invention.
Figure 8:
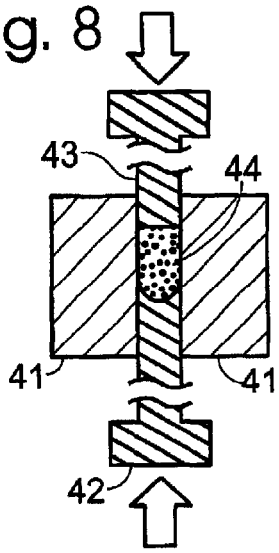
FIG. 8 is a schematic cross-sectional view of the reshaping die of FIG. 7, with the compacted intermediate structure undergoing reshaping according to the present invention.
Figure 9:
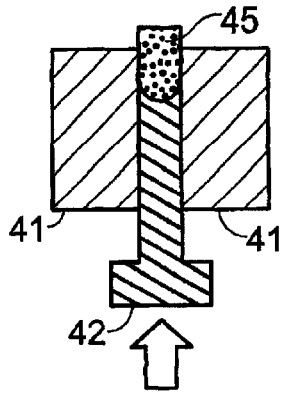
FIG. 9 is a schematic cross-sectional view of the reshaping die of FIGS. 7 and 8, where the lower punch is ejecting a reshaped article according to the present invention.

Illustrative examples of the reshaping step are shown graphically in FIGS. 7–9. In FIG. 7, intermediate structure 40 is placed in die 41 with opposing punches 42 and 43. In the context, of the punches used to form an article from an intermediate structure formed with a compaction punch assembly according to the present invention, punches 42 and 43 may be referred to as a reshaping punch assembly 39. Similar to the above discussion with respect to compaction punch assembly 5, reshaping punch assembly may include one or more punches, which each include a body, or head, and a structure-contacting face 46 that is adapted to engage, or contact, the intermediate structure as the reshaping pressure is applied to reform the structure into an article according to the present invention. In the illustrative example shown in FIG. 7, one of the structure-engaging faces has a flat shape and the other has a concave shape with an edge region 47 that forms an acute angle with body of the punch. Because the reshaping pressure is lower than the compaction pressure, the reshaping punch assembly may include thinner, or even knife-edged punches without experiencing, or without experiencing to the same degree, the strength and brittleness issues faced with the compaction punch assembly. In some embodiments, edge region 47 may extend generally toward or away from the other punch and may have a relatively thin thickness measured transverse to the direction upon which the punch is urged into the die. For example, edge region 47 may have a radial thickness of 0.01 inches or less, including a radial thickness of 0.005 inches, or less.

In FIG. 8, intermediate structure 40 is reshaped at a relatively lower pressure by punches 42 and 43. As shown in FIG. 9, the reshaped article 45 is typically dislodged from the die in a fashion similar to that of the intermediate structure, such as by advancing one of the punches to eject the article from the die. While it is within the scope of the invention that the die used in the reshaping process may be the same die used in the compaction process (although with at least one different punch), for reasons of manufacturing efficiency a different die and press is typically employed for reshaping. For example, the compacting die is typically equipped with a powder feed mechanism, while the reshaping die is typically equipped with a mechanism to feed the intermediate structure. Additionally, as the pressure demands of each press are substantially different, individual presses having different capabilities are typically used for each step.

Figure 10:
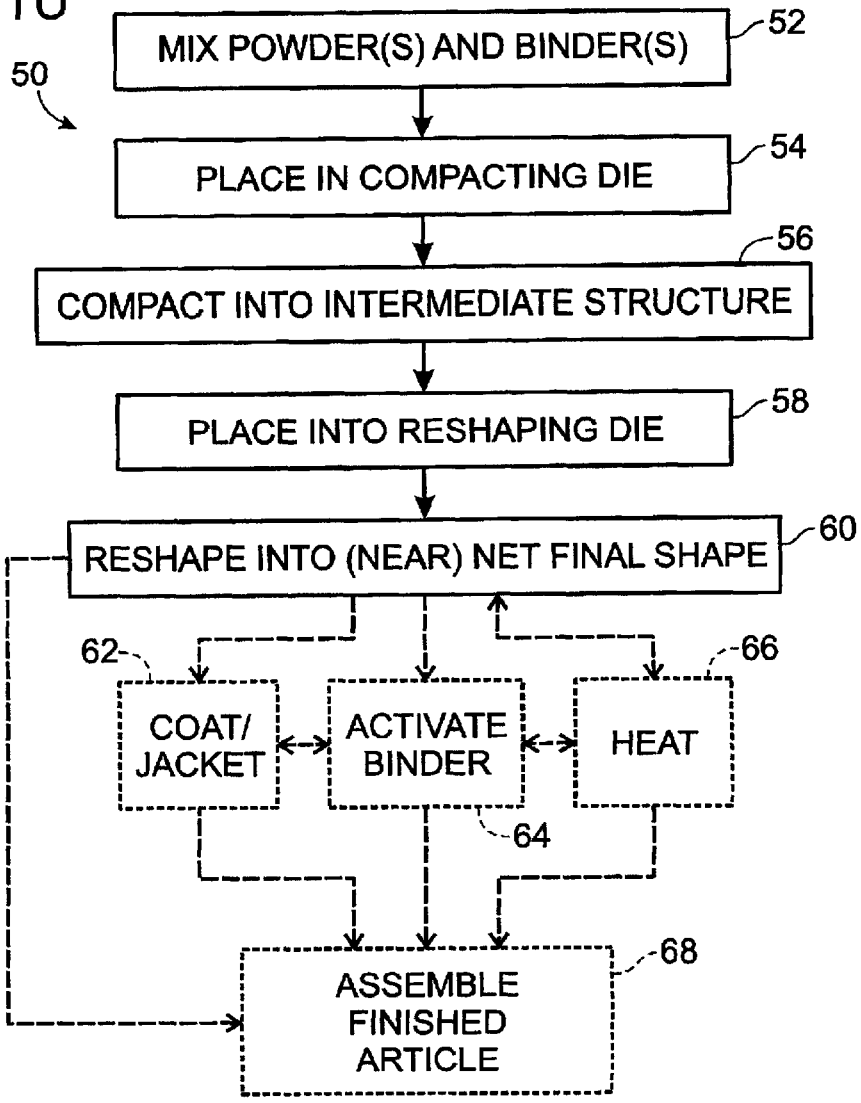
FIG. 10 is a flow chart illustrating methods for preparing the tungsten-containing articles of the present invention.

A flow chart depicting illustrative steps for forming (near) net final shape articles 45 according to the present invention is shown at 50 in FIG. 10. At 52 the above-described mixing step is shown. The amount of tungsten-containing powder 11 and binder 12 is selected based in part on one or more of the desired density of the finished article, the force with which the composition will be compacted, and the densities of powder 11 and binder 12, and the intended application and/or processing steps for the article. For example, when tungsten-containing powder 11 contains ferrotungsten powder and tungsten heavy alloy (WHA) powder that has a higher density than the ferrotungsten powder, less of the tungsten-containing powder will be required to obtain the same density as a corresponding article made without WHA powder.

The tungsten-containing powder 11 and binder 12 may be mixed together via any suitable mechanism appropriate for tungsten-containing powder and the particular type or types of binder 12 being used. Illustrative and non-exclusive examples of suitable mechanisms include blenders, such as a V-cone blender, and grinding mills. When binder 12 includes a metallic binder component, a high-energy mill or attritor may optionally be used to obtain mechanical alloying effects, such as described in U.S. Pat. No. 6,248,150, the complete disclosure of which is hereby incorporated by reference for all purposes.

As shown at step 54 of FIG. 10, the mixed powders are placed into a compacting die, such as a profile die, or other suitable mold or shape-defining device or devices that defines at least substantially the desired shape of the intermediate structure and which provides a base or frame against which the powder and binder may be compressed. The composition of matter is then compressed, as indicated graphically in FIG. 10 at 56. The step of compacting into the desired intermediate structure may utilize any suitable compressive rams, punches, presses, or other pressure-imparting devices or mechanisms.

As discussed above, the high pressure used in the compacting step reduces the voids or free-space within the intermediate structure, thereby increasing the density of the structure. By way of background, all mixtures of powdered components have a theoretical density that can be calculated based on the compositions and weight percentages of the powders. Typically, an article produced by compacting these powders will not achieve this theoretical density because of voids or free-spaces within the article. As the mixture of powders is compacted at higher pressures, the amount of void space is reduced, or even eliminated.

As shown at 58 in FIG. 10, the compacted structure is then placed into a reshaping die, which may be the same or different from the compacting die. The reshaping die defines at least substantially the desired shape of the final article and provides a base or frame against which the intermediate structure may be reshaped. The intermediate structure is then reshaped into a second structure having a net final shape, or near net final shape, as indicated graphically in FIG. 10 at 60. Compressive rams, punches, presses, or other suitable pressure-imparting devices or mechanisms may be used to reshape the intermediate structure.

The step of reshaping the intermediate structure may be accomplished without heating the intermediate structure. Additionally or alternatively, the intermediate structure may be heated, including heating to the point of annealing and/or sintering, as shown in FIG. 10 at 66. Although graphically illustrated as occurring after compression step 60 in FIG. 10, it is within the scope of the invention that any one or more of the above-described types of heating of the intermediate structure and/or article may occur at one or more stages within the formation process, including before, during and/or after the compression step. It also should be understood that heating is not required and that articles 45 may be produced according to the present invention without requiring the composition of matter to be heated. Typically, frangible articles are not sintered, but they may or may not be heated or annealed. Sintering may be either solid-phase sintering, in which the article is heated to near the melting point of the lowest melting component, or liquid-phase sintering, in which the article is heated to or above the melting point of the lowest melting component.

In some embodiments, after reshaping step 60 and/or heating step 66, article 45 has the desired net final shape for use of assembly into a finished article, as indicated at 68 of FIG. 10. In some embodiments, the compacted composition of matter forms a core that is thereafter coated or jacketed, as indicated at 62. For example, and as discussed previously, some bullets and other firearms projectiles are jacketed and it may be desirable to coat a compacted article according to the present invention to protect the article during handling, processing and/or assembly into a finished article.

As indicated at 64, some binders 12, such as many polymeric binders, require actuation to achieve the desired cross-linking, curing, setting or adhesion. The particular method of actuating the binder will tend to vary depending upon such factors as the particular binder or binders being used. For example, some binders are actuated by heating. Others are actuated by hydration, and still others are actuated by compression. It should be understood that the actuating step may, in some embodiments, occur during the compression step, such as when heat or pressure are used to actuate the binder.

Examples of heat-actuated binders include thermoplastic resins and thermoset resins, including the subsequently described rebar epoxies. It has been found that heating articles, and especially smaller articles such as bullets, shot, golf club weights and some fishing weights, at a temperature in the range of approximately 150° F. and approximately 445° F. for a time period in the range of 30 seconds and several hours is effective. Some compositions of matter according to the present invention may have a greater tendency to crack as they are exposed to higher temperatures for longer periods of time, and therefore it should be understood that the temperature and time period may vary depending upon the particular composition being used. Other illustrative temperature ranges for heating article according to the present invention include heating at a temperature less than approximately 250° F., less than approximately 200° F., and in the range of approximately 150° F. and approximately 175° F. Similarly, heating for less than approximately 15 minutes has proven effective, with heating for less than approximately 5 minutes being suitable for many applications.

Because the particular composition of the final article will vary depending on the particular powders and binders being used, and relative concentrations thereof, it should be understood that temperatures outside of this range may be effective for a particular article. For example, articles in the form of bullets using melamine as a polymeric binder have been effectively cured at temperatures in the range of 340° F. and 410° F. for several minutes without cracking. It should also be noted that curing rebar epoxies at 150–175° F. for approximately 5 minutes has proven effective when these epoxies are used as the polymeric binder, despite the fact that these epoxies are normally cured at much higher temperatures when used as rebar epoxies.

Examples of water-actuated binders include Portland cement, vinyl cement and urea formaldehyde. Typically, the actuation step includes immersion of the articles in water, followed by a drying period. For most water-actuated binders, an immersion, or water-contacting, period of less than an hour, and preferably less than a minute and even more preferably approximately 5–10 seconds was sufficient.

As discussed, the product of the reshaping process may include a coated or uncoated core that forms a component or portion of a finished article, which also includes other structures or components. When such an article is to be formed, the finished article is typically (but not necessarily in all embodiments) assembled after the compression step and/or after the coating, actuation or heating steps, as indicated in FIG. 10 at 68. For example, bullets or shot may be incorporated into firearms cartridges or shells, golf club weights may be incorporated into golf clubs, etc.

Figures 11, 13, 14, 15, 16:
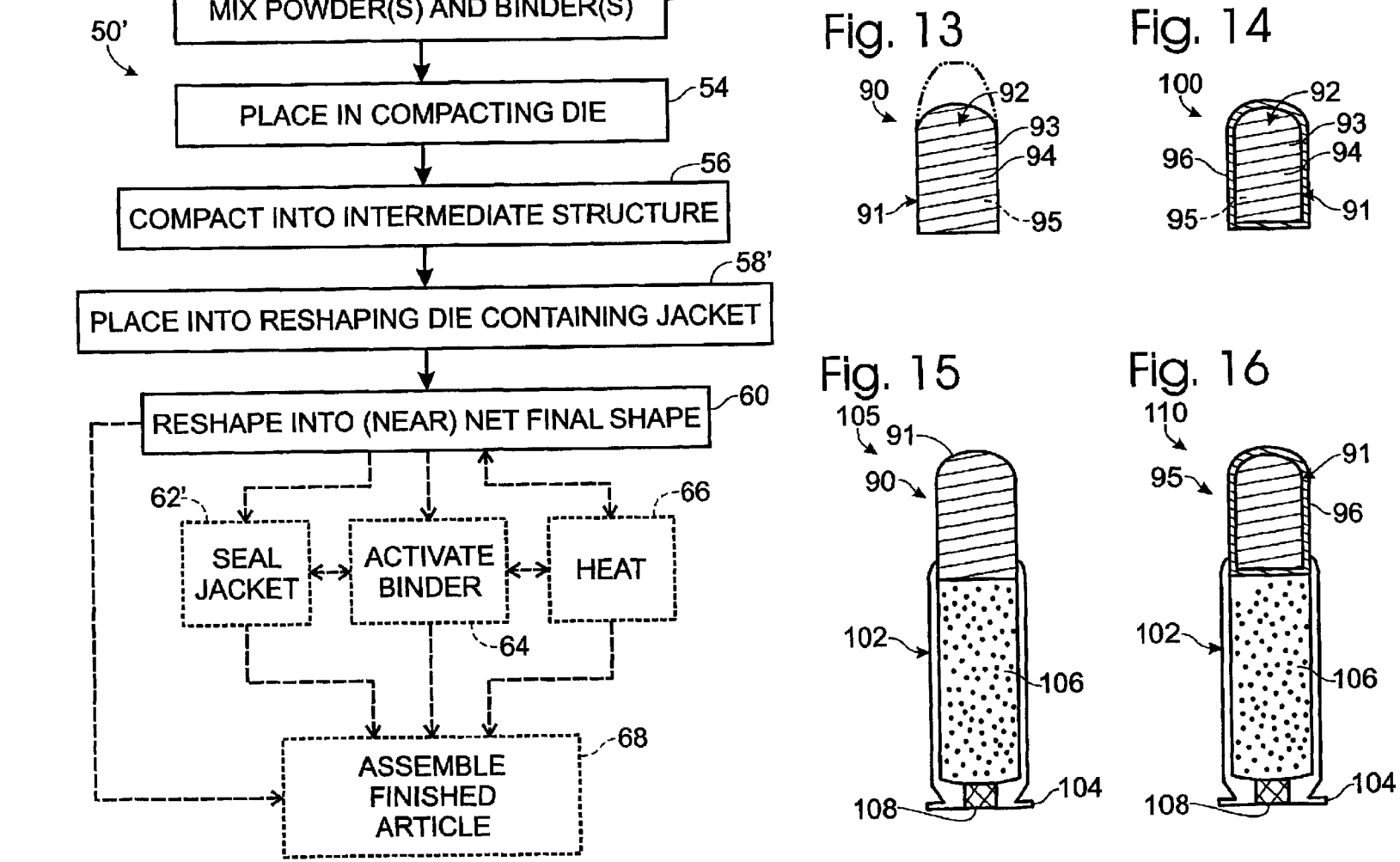
FIG. 11 is a flow chart illustrating methods for preparing the tungsten-containing articles according to another aspect of the present invention.
FIG. 13 is a schematic side elevation view of a bullet according to the present invention.
FIG. 14 is a schematic side elevation view of a jacketed bullet according to the present invention.
FIG. 15 is a schematic cross-sectional view of a firearms cartridge including the bullet of FIG. 13.
FIG. 16 is a schematic cross-sectional view of a firearms cartridge including the jacketed bullet of FIG. 14.

When a jacketed article is to be formed, it is possible to place the compacted intermediate structure into the jacket prior to reshaping the structure. Examples of these methods are shown in FIG. 11 at 50'. It should be understood that step 58' may include any suitable method of placing the intermediate structure into a jacket and placing the jacket into a die or other suitable mold. As the method depicted in FIG. 11 includes partially jacketing the composition of matter prior to compression, the jacket only needs to be sealed after compression and/or actuation, as indicated at 62'.

Figure 12:
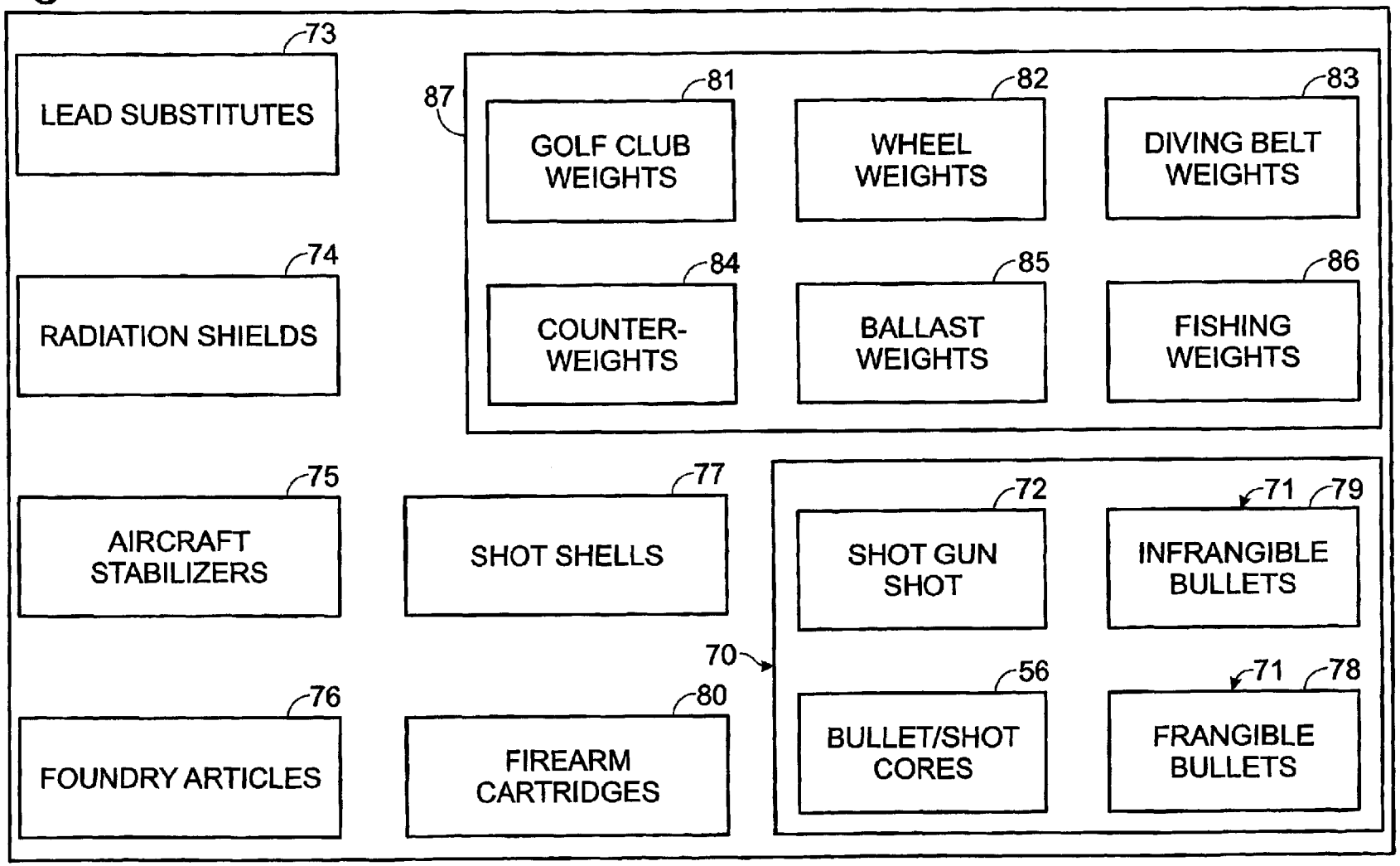
FIG. 12 is a schematic diagram showing illustrative examples of tungsten-containing articles manufactured according to the present invention.

As described above, the product of the reshaping step is typically in net final form, or near net final form. In one aspect of the invention, the final article needs no further processing. In another aspect of the invention, the final article needs only minimal polishing or smoothing before manufacture is complete. The final article may take a variety of forms, including being used to form articles that conventionally have been produced from lead. However, unlike lead, the final article is preferably formed from non-toxic (at least in the concentration and composition present in the article), environmentally safe components. Articles constructed according to the present invention are preferably lead-free, especially in the context of articles that will be used for water-related activities such as bird hunting and fishing. Illustrative examples of articles that may be formed according to the present invention include a firearms projectile 70, such as a bullet 71 or a shot 72, a radiation shield 74, aircraft stabilizer 75, foundry article 76, lead substitute 73, or weights 87, such as a golf club weight 81, wheel weight 82, diving belt weight 83, counterweight 84, fishing weight 86, ballast weight 85, etc. Examples of these articles are schematically illustrated in FIG. 12. In FIG. 12, two exemplary types of bullets 71 are shown, namely frangible bullets 78 and infrangible bullets 79. Also shown in FIG. 12 are articles in the form of cores 62 for shot or bullets, shot shells 77 and firearms cartridges 80.

Where the article constructed according to the invention is a bullet, the bullet is optionally a jacketed bullet. Because bullets are commonly expelled from firearms at rotational speeds greater than 10,000 rpm, the bullets encounter significant centrifugal forces. When the bullet is formed from powders, there is a tendency for these centrifugal forces to remove portions of the bullet during firing and flight. A jacket that partially or completely encloses the bullet core may be used to prevent these centrifugal forces from fragmenting, obturing (deforming on account of fragmenting and centrifugal forces), and/or dispersing the core during flight.

Where the bullet of the invention is jacketed, the jacket may partially or completely enclose the bullet core. For example, it is within the scope of the invention that the jacket may completely enclose the bullet core. Alternatively, the jacket may only partially enclose the core, thereby leaving a portion of the core not covered by the jacket. For example, the tip of the bullet may be unjacketed. Additionally, the bullet jacket may have a variety of thicknesses. Typically, the jacket will have an average thickness of approximately 0.025 inches or less, including an average thickness of approximately 0.01 inches or less.

An example of a suitable material for jacketing the bullets of the invention is copper, although other materials may be used. For example, a jacket may be additionally or alternatively formed from one or more other metallic materials, such as alloys of copper like brass, a ferrous metal alloy, or aluminum. A jacket may also be formed from a non-metal material, such as a polymer or a plastic. An example of such a material is nylon. When the jacket is formed from metallic materials, the bullet may be formed by reshaping the intermediate bullet structure in the jacket during the reshaping step to produce a jacketed bullet. Alternatively, the bullet core may be formed and thereafter placed within a jacket. As another example, the bullet core may be formed and then the jacket may be applied over the core by electroplating, vapor deposition, spray coating or other suitable application methods. For non-metallic jackets, dip coating, spray coating and similar application methods have proved effective.

Some firearms, such as handguns, rifles and rifled shotguns, have barrels with rifling that projects internally into the barrels to impart axial rotation to the bullet. Accordingly, a jacketed bullet according to the present invention preferably has a jacket thickness that exceeds the height of the rifling. Otherwise, it may be possible for the rifling to cut through the jacket and thereby expose the bullet core. This, in turn, may affect the flight and performance of the bullet, as well as increase fouling of the barrel. A jacket thickness that is at least 0.001 inches, and preferably at least 0.002 to 0.004 inches thicker than the height of the rifling lands have proven effective. For most applications, a jacket that is at least 0.005 inches thick should be sufficient. In firearms, such as shotguns, that have barrels with smooth (non-rifled) internal bores, a thinner jacket may be used, such as a jacket that is 0.001–0.002 inches thick. However, it should be understood that it is not required in these applications for the jacket to be thinner and that thicker jackets may be used as well.

Firearms projectiles constructed according to the present invention may be either ferromagnetic or non-ferromagnetic, as discussed previously. Similarly, projectiles may be frangible or infrangible. For example, in some applications it may be desirable for the projectile to be infrangible to increase the penetrating strength of the projectile. Alternatively, it may be desirable in other applications for the projectile to be frangible to decrease the penetrating strength and potential for ricochet of the projectile. For example, frangible projectiles may be desired when the projectiles will be used for target practice.

By "frangible," it is meant that the projectile is designed to remain intact during flight but to break into pieces upon impact with a relatively hard object. Frangible projectiles may also be referred to as non-ricocheting projectiles. Although it is within the scope of the present invention that the projectile is constructed, or designed, to break into several pieces upon impact, it is preferred that where the projectile is a frangible projectile, that it is at least substantially reduced to powder upon impact, and even more preferable that the projectile is completely reduced to powder upon impact. By "substantially reduced to powder" it is meant that at least 50% of the projectile (metallic powder 11 and binder 12) is reduced to powder. Preferably, at least 75% of the projectile and even more preferably at least 95% of the projectile is reduced to powder upon impact. Another exemplary construction for a frangible projectile is a projectile in which the resulting particles from the composition of matter forming the bullet (or core) each weigh less than 5 grains (0.324 grams). When the projectile or other article is frangible, it may be coated, painted, or plated to reduce particle loss during handling and machining. For example, a wax, epoxy or metal coating may be used.

The powder that results upon disintegration of a frangible projectile may contain contaminants such as portions of targets, debris and the like that are mixed with the powdered bullet when the powder is accumulated. In embodiments in which tungsten-containing powder 11 is selected to be ferromagnetic, such as by including ferrotungsten, the tungsten-containing powder 11 may be recovered from the resultant powder, portions of jacket and contaminants using a magnet. Similarly, magnets may be used to recover magnetic projectiles from bodies of water and from shooting ranges. Such a projectile may also be referred to as a recyclable projectile because it is easily reclaimed. Using a ferromagnetic tungsten-containing powder 11 also enables an easy determination, using a magnet, that the projectile is not formed from lead, which is not magnetic.

Although ferromagnetic powders may be desirable in some applications, it is within the scope of the present invention that tungsten-containing powders may be used that are not ferromagnetic or which do not produce a ferromagnetic intermediate structure or article in the concentration in which the powder is present.

An article constructed according to the invention in the form of a bullet 90 is schematically illustrated in FIG. 13. It should be understood that bullet 90 may take any suitable shape and configuration, such as those known in the art for conventional bullets. For example, bullet 90 may have a more pointed configuration, such as indicated in dashed lines in FIG. 13. As also indicated in dashed lines at 95 in FIG. 13, the article may also form a core for a jacketed bullet, which is also shown in FIG. 14. When bullet core 95 is encased in a protective jacket 96, it may be referred to as a jacketed bullet 100. Jacket 96 may at least substantially, if not completely, enclose core 95. Accordingly, it should be understood that the depicted thickness of the jacket and relative thickness of the jacket compared to the overall shape and size of the bullet in FIGS. 14 and 16 have been exaggerated for the purpose of illustration.

In FIG. 15, an article in the form of a firearms cartridge 105 containing bullet 90 is shown. Cartridge 105 includes bullet 90 and a case or casing 102. Casing 102 includes a cup 104, a charge 106 and a primer, or priming mixture, 108. Casing, primer and charge may be of any suitable materials, as is known in the art of firearms. Cartridge 105 is ready to be loaded into a gun, such as a handgun, rifle or the like, and upon firing, will discharge bullet 90 at high speeds and with a high rate of rotation. Although illustrated in FIG. 15 as a centerfire cartridge, in which primer 108 is located in the center of the base of casing 102, bullets according to the present invention may also be incorporated into other types of cartridges, such as a rimfire cartridge, in which the casing is rimmed or flanged and the primer is located inside the rim of the casing. In FIG. 16, jacketed bullet 100 is shown forming a component of an analogous cartridge 110.

The tungsten-containing powder 11 utilized in preparing the articles of the invention may take a variety of forms, from powders of pure tungsten (density 19.3 g/cc), powders of a tungsten alloy, powders of more than one tungsten alloy, and combinations thereof. Examples of suitable tungsten alloys are collectively referred to as "WHA's" (tungsten heavy alloys) and have densities in the range of approximately 15 g/cc to approximately 18 g/cc, and often have a density of 17 g/cc or approximately 17 g/cc. These powders are especially well-suited for use in firearms projectiles, weights or other lead substitutes because they can be mixed with less dense materials, such as binder 12, to produce a medium-density article, such as in the ranges identified above, including densities at or near (within 0.01–0.5 g/cc) the density of lead (11.3 g/cc, or 11.1–11.2 g/cc for conventional lead-antimony alloys used for firearms projectiles), or even denser than lead (12–13 g/cc).

Examples of suitable tungsten alloys include, but are not limited to, W—Cu—Ni, W—Co—Cr, W—Ni—Fe, W—Ni, WC (tungsten carbide), W—Fe (ferrotungsten) and alloys of tungsten and one or more of nickel, zinc, copper, iron, manganese, silver, tin, bismuth, chromium, cobalt, molybdenum and alloys formed therefrom, such as brass and bronze. Powders formed from medium-density tungsten alloys may also be used as a suitable source of tungsten-containing powder 11. For example, W—Ni—Fe alloys having densities in the range of 10–15 g/cc and more particularly in the range of 11–13 g/cc or approximately 12 g/cc have proven effective, although others may be used. Still further examples of suitable compositions for tungsten-containing powder 11 include powders formed from 73.64% WHA and 26.36% iron; 70% WHA and 30% zinc; 80% WHA and 20% zinc; 80% WHA, 19% zinc and 1% lubricant; 68% WHA and 32% copper; 68% WHA, 31.5% copper and 0.5% lubricant; 70% WHA and 30% tin; and 70% WHA, 29.5% tin and 0.5% lubricant. The individual tungsten-containing powders may vary in coarseness, or mesh-size.

A particularly well-suited tungsten-containing powder 11 is ferrotungsten powder, which typically has a density in the range of 14–15 g/cc. Another suitable tungsten-containing powder is WHA powder, such as 90W7Ni3Fe (percentage by weight) and similar compositions containing at least 80% tungsten, such as 85–95 wt % tungsten with corresponding percentages of iron and/or nickel. Further examples of suitable tungsten-containing powders 11 include tungsten-containing powders that have been high-energy milled with one or more other metallic powders to produce mechanical alloying effects, as disclosed in U.S. Pat. No. 6,248,150, the complete disclosure of which is hereby incorporated by reference.

Still other well-suited tungsten-containing powders 11 are powders produced from recycled tungsten or recycled tungsten alloys, such as waste materials formed when tungsten or tungsten alloys are forged, swaged, drawn, cropped, sawed, sheared, and machined. Operations such as these inherently produce a variety of metallic scrap, such as machine turnings, chips, rod ends, broken pieces, rejected articles, etc., all of which are generated from materials of generally high unit value because of their tungsten content. Illustrative processes for obtaining this powder, and compositions of such powder are disclosed in co-pending U.S. patent application Ser. No. 09/483,073, which is entitled "Methods for Producing Medium-Density Articles from High-Density Tungsten Alloys," was filed on Jan. 14, 2000, and the complete disclosure of which is hereby incorporated by reference.

The compacted intermediate structure 16 (and therefore the corresponding final product of the manufacturing process) may be ferromagnetic or non-ferromagnetic, depending upon the particular compositions and weight percentages of the tungsten-containing powder 11 used to form the composition of matter. When the composition is ferromagnetic, it may be recovered using a magnet, which may be beneficial in applications in which the article is propelled away from a user during use and/or fragmented during use, such as in the context of articles in the form of firearms projectiles and fishing weights. A further feature of a ferromagnetic article constructed according to the present invention is that this ferromagnetism may be used to distinguish ferromagnetic lead-substitutes constructed according to the present invention from lead products.

With the addition of binder 12, the discontinuous-phase of tungsten-containing powder 11 may be formed into a continuous-phase matrix without requiring the tungsten-containing powder to be melted. In other words, binder 12 enables the loose tungsten-containing powder to be formed into an at least relatively defined and durable shape without requiring melting and casting of powder 11. Binder 12 may include at least one of a metallic binder and a polymeric binder.

Where the binder 12 is a metallic binder, it typically is added in powder form to tungsten-containing powder 11. The powders are then mixed to yield mixture 10, and then compacted to form structure 16. In one aspect of the invention, the binder is a metallic binder that includes tin. A tin-containing powder may be pure or at least substantially pure tin powder. Tin has a density of 7.3 g/cc. Mixture 10 may also include elements other than tin, such as a powder containing a tin alloy, such as bronze. However, tin should form at least 40 wt %, and preferably at least 50 wt % of powder mixture 10.

The weight percentage of tin-containing powder in structure 16 may vary depending upon such factors as the desired density of the uncompacted and the finished article, the density and amount of other components in the article, the desired strength of the article and the desired flow and ductility of the article. It is within the scope of the invention that a tin-containing powder is present in mixture 10 in the range of 5 wt % and 60 wt %. In some embodiments, the tin-containing powder will be present in the range of 10 wt % and 50 wt %, in the range of 15 wt % and 40 wt %, and in the range of 20 wt % and 30 wt %. In some embodiments, mixture 10 will contain at least 10 wt % of tin-containing powder, in some embodiments mixture 10 will contain less than 50 wt % of tin-containing powder, in some embodiments the tin-containing powder will form the largest component (by particle weight percentage and/or by elemental weight percentage) in mixture 10.

A factor that contributes to the ability of a tin-containing powder to form an effective binder for structure 16 is tin's ability to anneal itself. In other words, tin can be cold worked, or reformed, repeatedly and still establish metallic bonding between itself and tungsten-containing powder 11.

Where binder 12 is a non-metallic or polymeric binder, binder 12 may include any suitable polymeric material, or combination of polymeric materials. Examples of suitable polymeric binders include thermoplastic resins and thermoset resins, which are actuated, or cross-linked, by heating. Examples of suitable thermoset resins are melamine and powder-coating epoxies, and examples of suitable thermoplastic resins are nylon (including nylon 6), polyethylene, polyethylene glycol and polyvinyl alcohol. Other suitable polymeric binders are water-actuated polymers, such as Portland cement, vinyl cement and urea formaldehyde, which are actuated by immersion or other contact with water. Still another example of a suitable polymeric binder is a pressure-actuated polymer, such as gum arabic. Still further examples of polymeric binders that may be used are gelatin powder and stearic acid.

Particularly well-suited polymeric binders are elastomeric, or flexible, epoxies, which are thermoset resins that are suitable for use as corrosion-resistant coatings on rebar. Because rebar is often bent after being coated, its coating must bend with the rebar to provide the intended corrosion resistance. As such, these epoxies are often referred to as "rebar epoxies." Through experimentation, it has been discovered that these epoxies are particularly well-suited for use as a polymeric binder 12 for forming articles according to the present invention. Examples of suitable elastomeric epoxies for use as binder 12 are sold by the 3M Corporation under the tradename 3M 413™ and by the Dupont Corporation under the trade name 2-2709™. It should be understood that other elastomeric or flexible epoxies may be used and are also within the scope of the invention.

Polymeric binder 12 will typically comprise in the range of approximately 0.1 wt % and approximately 10 wt % of mixture 10, and preferably is present in the range of approximately 0.2 wt % and approximately 3 wt %. An example of a subset of this range is approximately 0.25 wt % and approximately 0.65 wt %. It should be understood that percentages outside of this range may be used, however, the amount of binder is typically rather small because polymeric (and other non-metallic) binders 12 tend to have much lower densities than tungsten-containing powder 11. Accordingly, the greater the percentage of binder 12 in mixture 10, the lower the density of the resulting structure compared to an analogous structure prepared with a lesser amount of the polymeric binder. This is an important consideration to remember, especially as the desired density of structure 16 increases. For example, as the amount of binder is increased, it may be necessary to use a greater amount of tungsten-containing powders having higher densities to achieve a desired density in the article formed thereby. Similarly, tungsten-containing powders tend to be more expensive than binders 12, and therefore, this would increase the materials cost of the resulting article.

Illustrative, non-exclusive examples of proportions of binders that have proven effective include 1–2 wt % melamine, 1.5–5 wt % Portland or vinyl cement, 2–3 wt % urea formaldehyde, and 2–3 wt % gum arabic, with all or at least a substantial portion of the remainder of mixture 10 being formed from tungsten-containing powder 11. It should be understood that these exemplary proportions have been provided for purpose of illustration and that other percentages of these binders may be used and are within the scope of the present invention. Non-exclusive examples of suitable compositions for medium-density compositions and/or articles according to the present invention include the following: 100 g of WHA/Fe (73.64%WHA/26.36%Fe), 161 g of WHA, 4–8 g binder; 50 g WHA/Fe (73.64%WHA/256.36%Fe), 80.5 g WHA, 4 g 3M431™ and 0.27 g lubricant; 65.25 g WHA, 65.25FeW (73.64%WHA/256.36%Fe), 4 g 3M431™ and 0.27 g lubricant; 130.5 g FeW, 3.5 g 3M431 and 0.27 g lubricant; and 116.5 g FeW, 14 g Fe, 2.4 g 3M431™ and 0.27 g lubricant. Acrawax™ is an example of a suitable lubricant.

It is also within the scope of the invention that binder 12 may include two or more different types of polymeric or other non-metal binders. For example, a combination of a rigid epoxy and a flexible epoxy may be used to produce an article that has increased strength over a comparable article formed with only a rigid epoxy or only a flexible epoxy. When more than one binder 12 is used, it is preferable that the binders are actuated through the same or compatible mechanisms.

Another example of a suitable binder 12 for mixture 10 and articles formed therefrom is a combination of at least one metallic binder component and at least one non-metallic or polymeric binder component. For example, binder 12 may constitute approximately 2–30 wt % of the article or composition of matter, with tungsten-containing powder constituting at least a substantial portion, if not all, of the rest of the mixture or resulting structure. In such an embodiment, the metallic binder component will typically constitute a majority of the binder, and may constitute as much as 70 wt %, 80 wt %, 90 wt %, or more of the binder. A benefit of binder 12 including both metallic and non-metallic binders compared to only polymeric binders is that polymeric binders tend to swell or otherwise expand during actuation of the binder. This expansion decreases the density of the resulting composition of matter or article. However, when binder 12 also includes a metallic binder component, such as a tin-containing powder, this swelling is substantially reduced or eliminated.

As an illustrative example, tin or another tin-containing powder and one or more (flexible and/or rigid) thermoset epoxies have proven effective in experiments. In experiments, a mixture was prepared from 88.2 wt % tungsten-containing powder (such as tungsten or ferrotungsten), and 21.8 wt % tin-containing powder (such as pure tin). When 0.2 wt % of the tin-containing powder was replaced with epoxy and the resulting composition was actuated, the crushing strength was approximately doubled. When approximately 0.5 wt % of the tin-containing powder was replaced with epoxy, the crushing strength of the composition was approximately quadrupled. Continuing the above example for purposes of illustration, the same or similar substitutions of polymeric binder component for metallic binder component and/or tungsten-containing powder may be used with the compositions presented above.

The size of the individual particles of the components of mixture 10 may vary. In the context of at least firearms projectiles in which binder 12 includes a tin-containing powder, a nominal (average) particle size of 150 mesh has proven effective for preparing powder mixture 10. Similarly, a tin-containing powder having a nominal size of 80 mesh, with no more than 75% being minus 325 mesh has also proven effective. Suitable tin-containing powder is available from Acupowder, Inc. and sold under the trade name Acu-150™. Similarly, tungsten-containing powder in the form of ferrotungsten powder having a particle size of minus 100 mesh, minus 140 mesh and minus 200 mesh has proven effective, with less than 10–12% being minus 325 mesh being particularly effective. Tungsten-containing powder in the form of WHA powder having a size of minus 40 mesh also has proven effective.

It should be understood that these particle sizes are presented for purposes of illustration and not limitation. Similarly, the acceptable particle sizes may vary depending upon the particular mix and composition of powders used to form mixture 10, as well as the particular shape, size and/or application of the article to be formed. For example, when structure 16 is prepared by compaction and densification of mixture 10 in a die using at least one punch, it is desirable for the non-compacted mixture of powders to have sufficient flowability (Hall flow test) to readily fill the die that gives the resulting structure its shape. In some embodiments, it may be desirable for the lower density powder(s) to be finer than the higher density powder(s) to discourage separation of the powders after mixing but prior to compaction.

It should also be understood that mixture 10 and structure 16 may include components other than tungsten-containing powder 11 and binder 12. For example, the composition containing powder 11 and binder 12 may, but does not necessarily, include a relatively small component, such as between approximately 0 and approximately 1 wt %, of a suitable lubricant, such as to facilitate easier removal of the structure from a die. It should be understood that any of the intermediate structures 16 or final articles discussed, incorporated and/or illustrated herein may include a lubricant. An example of a suitable lubricant is Acrawax™ dry lubricant, although others may be used. Similarly, when the article is formed with a binder 12 that includes tin-containing powder, the powder may provide sufficient lubrication.

The following table provides examples of compositions and resulting densities of articles, such as firearms projectiles, constructed according to the present invention.

TABLE 2

Densities of Compositions and Articles Produced from Tin- and Tungsten-Containing Powders

| FeW powder | WHA powder | Tin Powder | Lubricant | Density (g/cc) |
|---|---|---|---|---|
| 58 | 20 | 21.8 | 0.2 | 11–11.7 |
| 68 | 10 | 21.8 | 0.2 | 11.2 |
| 78 | 0 | 21.8 | 0.2 | 11–11.7 |
| 78 | 0 | 22 | 0 | 11 |
| 38–78 | 0–40 | 21.8 | 0.2 | 11+ |
| 0 | 68 | 31.5 | 0.5 | |
| 0 | 70 | 29.5 | 0.5 | |
| 0 | 75 | 24.5 | 0.5 | |
| 66 | 0 | 34 | 0 | 10–10.25 |
| 48–43 | 30–35 | 22 | 0 | 11.5–11.7 |
| 38–28 | 40–50 | 22 | 0 | 12 |
| 0 | 78 | 22 | 0 | 12.8–13 |
| 10 | 0 | 90 | 0 | 7.68 |
| 20 | 0 | 80 | 0 | 8.067 |
| 50 | 0 | 50 | 0 | 9.729 |
| 0 | 10 | 90 | 0 | 7.74 |
| 0 | 20 | 90 | 0 | 8.24 |
| 0 | 50 | 50 | 0 | 10.2 |
| 30 | 40 | 30 | 0 | 10.92 |
| 43 | 35 | 21.8 | 0.2 | 11.5–.7 |
| 43 | 35 | 22 | 0 | 11.7–11.9 |

The above examples are presented to provide illustrative, non-limiting examples of articles that may be produced according to the present invention. For example, only ferrotungsten and WHA tungsten-containing powders and at least essentially pure tin powder as a tin-containing powder are shown in the table, but it is within the scope of the invention that other tungsten-containing powders, including pure tungsten and tungsten carbide, and other tin-containing powders may be used. Similarly, powder mixture 10 and structure 16 may include additional components as well, such as powders of other metals or metal alloys. For example, iron powder may be added to reduce the density of the article that otherwise would have a density greater than that of lead. Non-exclusive examples of other suitable compositions that may be used to form articles according to the present invention are disclosed in U.S. patent application Ser. No. 10/041,873, which is entitled "Tungsten-Containing Articles and Methods for Forming the Same," was filed on Jan. 7, 2002, and the complete disclosure of which is hereby incorporated by reference for all purposes.

INDUSTRIAL APPLICABILITY

The present invention is applicable to any powder metallurgy application in which powders containing tungsten and at least one binder are compressed to form articles, such as firearms projectiles, radiation shields, weights, and other lead substitutes.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A method for forming a tungsten-containing article, the method comprising:

compacting a mixture comprising a tungsten-containing powder and a binder under a first pressure to yield an intermediate structure; and reshaping the structure by applying a second pressure that is lower than the first pressure to yield a tungsten-containing article having a different shape than the intermediate structure.

2. The method of claim 1, wherein the intermediate structure and the article have at least substantially the same density.

3. The method of claim 2, wherein the intermediate structure and the article have densities that differ by no more than 0.2 g/cc.

4. The method of claim 2, wherein the intermediate structure has a density that is at least 10 g/cc.

5. An article according to the method of claim 4.

6. The method of claim 5, wherein the article is selected from the group consisting of lead substitutes, shotgun shot, frangible firearm projectiles, infrangible firearm projectiles, golf club weights, wheel weights, counterweights, ballast weights, aircraft stabilizers and radiation shields.

7. The method of claim 4, wherein the intermediate structure has a density in the range of 10.5 g/cc and 13 g/cc.

8. The method of claim 1, wherein the article is longer than the intermediate structure.

9. The method of claim 1, wherein the intermediate structure includes an end region and further wherein the article includes an end region that is more pointed than the end region of the intermediate structure.

10. The method of claim 1, wherein the intermediate structure has an at least substantially cylindrical configuration.

11. The method of claim 10, wherein the intermediate structure has a pair of at least substantially flat end regions.

12. The method of claim 11, wherein the article includes at least one end region that is neither flat nor at least substantially flat.

13. The method of claim 1, wherein the compacting step includes compressing the mixture in a die with a compaction punch assembly that includes at least one punch having a mixture-contacting face adapted to engage the mixture as the mixture is compressed to form the intermediate structure, and further wherein the reshaping step includes compressing the intermediate structure with a die with a reshaping punch assembly that includes at least one punch having a structure-contacting face adapted to engage the structure as the structure is compressed to form the article.

14. The method of claim 13, wherein the compaction punch assembly includes a pair of compaction punches that each include a mixture-contacting face, wherein the reshaping punch assembly includes a pair of reshaping punches that each include a structure-contacting face, and further wherein at least one of the structure-contacting faces has a different shape than the mixture-contacting faces.

15. An article according to the method of claim 14.

16. The method of claim 15, wherein the article is selected from the group consisting of lead substitutes, shotgun shot, frangible firearm projectiles, infrangible firearm projectiles, golf club weights, wheel weights, counterweights, ballast weights, aircraft stabilizers and radiation shields.

17. The method of claim 14, wherein both of the mixture-contacting faces have flat faces.

18. The method of claim 14, wherein one of the mixture-contacting faces has a concave face.

19. The method of claim 14, wherein at least one of the compaction punches includes a mixture-contacting face with an outer perimeter and a shoulder that extends inward from the outer perimeter.

20. The method of claim 19, wherein the shoulder extends at least 0.01 inches inward from the outer perimeter.

21. The method of claim 19, wherein the shoulder defines a plane extending generally parallel to a long axis of the compaction punch.

22. The method of claim 19, wherein the mixture-contacting face includes at least one of a depression and a projection internal of the shoulder.

23. An article according to the method of claim 22.

24. The method of claim 23, wherein the article is selected from the group consisting of lead substitutes, shotgun shot, frangible firearm projectiles, infrangible firearm projectiles, golf club weights, wheel weights, counterweights, ballast weights, aircraft stabilizers and radiation shields.

25. The method of claim 14, wherein each mixture-contacting face includes an outer perimeter that is free from sharp edges.

26. The method of claim 14, wherein each mixture-contacting face has an outer perimeter and a radial thickness at the outer perimeter that is greater than 0.01 inches, and optionally greater than 0.02 inches.

27. The method of claim 26, wherein at least one of the reshaping punches includes a structure-contacting face having an outer perimeter and a radial thickness at the outer perimeter that is less than 0.01 inches, and optionally less than 0.005 inches.

28. The method of claim 14, wherein the reshaping punch assembly includes a pair of reshaping punches and further wherein at least one of the reshaping punches includes a concave structure-contacting face having an edge region that extends generally toward the other reshaping punch.

29. The method of claim 14, wherein the reshaping punch assembly includes a reshaping punch having a head with a structure-contacting face having an edge region that forms an acute angle with the head.

30. The method of claim 1, wherein the first pressure is greater than approximately 50,000 lbs/in$^2$.

31. The method of claim 30, wherein the first pressure is greater than approximately 65,000 lbs/in$^2$.

32. The method of claim 1, wherein the second pressure is less than approximately 75,000 lbs/in$^2$.

33. The method of claim 32, wherein the second pressure is less than approximately 60,000 lbs/in$^2$.

34. The method of claim 32, wherein the second pressure is greater than 25,000 lbs/in$^2$.

35. The method of claim 1, wherein the tungsten-containing powder has a density of at least 15 g/cc.

36. The method of claim 35, wherein the tungsten-containing powder comprises ferrotungsten powder.

37. The method of claim 1, wherein the tungsten-containing powder comprises an alloy of tungsten, nickel, and iron.

38. A method of manufacturing a firearms projectile, the method comprising:

placing a mixture comprising a tungsten-containing powder and a binder into a die;

applying a first pressure to the mixture to produce an intermediate structure, wherein the first pressure is applied by a compaction die assembly that includes a pair of punches having mixture-engaging faces adapted to engage the mixture as the first pressure is applied; and reshaping the intermediate structure by applying a second pressure to the intermediate structure to produce an article selected from the group consisting of a bullet and a bullet core, wherein the second pressure is lower than the first pressure, wherein the second pressure is applied by a reshaping punch assembly having a pair of punches with structure-engaging faces adapted to engage the intermediate structure as the second pressure is applied, and further wherein the article has a density that is greater than 9 g/cc, and further wherein the article has a shape that is different than the shape of the intermediate structure.

39. The method of claim 38, wherein the article has a density of at least 10.5 g/cc.

40. The method of claim 39, wherein the article and the intermediate structure have at least substantially the same density.

41. The method of claim 38, wherein the intermediate structure has an at least generally cylindrical shape.

42. The method of claim 38, wherein at least one of the structure-engaging faces has a different shape than the mixture-engaging faces.

43. The method of claim 38, wherein the reshaping step includes placing the intermediate structure in a second die.

44. The method of claim 38, wherein the article is longer than the intermediate structure.

45. The method of claim 38, wherein the article is shorter than the intermediate structure.

46. The method of claim 38, wherein the article includes a generally pointed end region and the intermediate structure includes a corresponding end region that is either at least substantially flat or less pointed than the generally pointed end region of the article.

47. The method of claim 38, wherein at least one of the compaction punches includes a mixture-contacting face with an outer perimeter, a shoulder that extends inward from the outer perimeter, and at least one of a projection or a depression internal the shoulder.

48. The method of claim 38, further comprising the step of applying a jacket to the intermediate structure.

49. The method of claim 48, wherein the jacket is applied to the structure before the reshaping step.

50. The method of claim 48, wherein the jacket is applied to the structure after the reshaping step.

51. The method of claim 48, wherein jacket is applied to the structure by placing the intermediate structure in a jacket before the reshaping step.

52. The method of claim 51, further comprising mounting the bullet in an open end of a casing containing a propellant charge and a primer charge to form a firearms cartridge.

53. A firearms cartridge according to the method of claim 52.

54. The method of claim 38, wherein the tungsten-containing powder includes ferrotungsten powder.

55. The method of claim 38, wherein the tungsten-containing powder includes an alloy of tungsten, nickel and iron.

* * * * *